United States Patent [19]

Kaniecki

[11] 4,147,652

[45] Apr. 3, 1979

[54] LIQUID CLEANING CONCENTRATE

[75] Inventor: Thaddeus J. Kaniecki, Pompton Plains, N.J.

[73] Assignee: Stauffer Chemical Company, Westport, Conn.

[21] Appl. No.: 902,301

[22] Filed: May 3, 1978

Related U.S. Application Data

[63] Continuation-in-part of Ser. No. 750,036, Dec. 13, 1976, abandoned.

[51] Int. Cl.[2] ..... C11D 1/68; C11D 1/83; C11D 3/02; C11D 7/06

[52] U.S. Cl. ..... 252/156; 252/89 R; 252/173; 252/DIG. 1; 252/DIG. 10; 252/DIG. 14

[58] Field of Search ..... 252/89, 135, 156, DIG. 1, 252/DIG. 10, 173, DIG. 14

[56] References Cited

U.S. PATENT DOCUMENTS

| | | | |
|---|---|---|---|
| 3,437,598 | 4/1969 | De Voldre | 252/156 |
| 3,721,633 | 3/1973 | Ranauto | 252/527 |

OTHER PUBLICATIONS

Triton BG-5, Technical Bulletin of Rohm & Haas Co., Philadelphia, Pa., Jun. 1968, 9 pages.

*Primary Examiner*—Dennis L. Albrecht
*Attorney, Agent, or Firm*—Michael E. Zall

[57] ABSTRACT

An aqueous cleaning concentrate containing alkali metal hydroxide, a nonionic surfactant and an alkyl glucoside or alkoxylated glycidyl ether. The concentrate can be diluted with water or additional aqueous alkali metal hydroxide to provide a composition useful for washing bottles and other food and beverage containers.

3 Claims, No Drawings

LIQUID CLEANING CONCENTRATE

CROSS-REFERENCE TO RELATED APPLICATIONS

This application is a continuation-in-part of copending application U.S. Ser. No. 750,036, filed Dec. 13, 1976, now abandoned.

BACKGROUND OF THE INVENTION

This invention relates to liquid cleaning concentrates and more particularly to concentrates suitable for formulating alkali cleaning compositions having utility in the food industry.

The use of caustic solutions to wash glassware, such as bottles and other food and beverage containers, is widespread in the industry. In fact, the use of caustic solutions is generally controlled by law or by industry requirements. For example, regulations require dairies, soft drink plants and breweries to maintain a specified caustic concentration in their bottle washers. Generally, solid compositions are employed which are diluted in the plant prior to use in the cleaning equipment.

Thus, for example, U.S. Pat. No. 2,976,248 discloses a solid bottle washing composition containing 70–99 percent caustic, a sequesterant which may be gluconic acid and a potassium or sodium lignosulfonate, the latter component functioning as a corrosion-inhibiting agent. The aqueous solutions of these compositions contain from about 1 to 10 percent by weight of caustic. U.S. Pat. No. 2,584,017 discloses a solid composition containing both sodium hydroxide and sodium carbonate, sodium gluconate and wetting agent while U.S. Pat. No. 3,312,624 discloses formulations containing between 88–99 percent by weight of caustic and from 1 to 12 percent by weight of a particular surfactant blend.

Alkali based solid cleaning compositions for other uses have also been described in the prior art. For example, U.S. Pat. No. 3,583,923 describes a multi-component heavy duty cleaning composition which includes from about 35 to about 50 parts by weight of an alkali metal hydroxide. An oven cleaner containing 1.0 to 20 parts alkali metal hydroxide, gluconic acid and numerous other ingredients is described in U.S. Pat. No. 3,644,210.

While cleaning solutions prepared from such solid compositions have utility in various applications, the preparations of both the solid composition and the aqueous solution present difficulties. Thus, solid compositions containing sodium hydroxide are difficult to prepare, requiring careful handling and expensive equipment. Typical are the teachings of U.S. Pat. Nos. 2,767,146 and 2,804,432. The former patent teaches a composition containing gluconic acid and sodium hydroxide made by spraying gluconic acid solution upon powdered, flake or granular sodium hydroxide. It is taught that the problem of forming particles of this character is aggravated by the excessive heat created by the exothermic reaction of gluconic acid with sodium hydroxide. Special equipment and/or techniques are taught to obviate this difficulty. U.S. Pat. No. 2,804,432 teaches a process for making similar particles by adding gluconic acids in aqueous solution to a hot supersaturated aqueous solution of the caustic, mixing the two solutions together while cooling the mixture until solid non-adherent particles are formed. Again, critical processing variables are involved in order to obtain the desired product.

In addition to being difficult to formulate, solid compositions containing large amounts of caustic are hazardous to ship and present problems in the customer's plant. Thus, the desired cleaning solution must be made on site using these solid pellets. Accordingly, dilute caustic solutions have been proposed in the art. Thus, U.S. Pat. No. 3,653,095 describes an alkaline solution containing up to 10 percent alkali, alkyl glycoside and a selected metal ion in combination with certain surface active agents. The compositions are taught to protect substrates such as aluminum, zinc, tin, lead, alloys thereof and siliceous compositions from attack by the alkaline solution. Although dilute alkaline solutions obviate the processing, storage and handling problems inherent in solid compositions, they are subject to severe economic disadvantages in that large quantities of water must be shipped to the customer.

While the preparation of liquid compositions containing reasonably concentrated amounts of alkali has been a desirable objective, the solution problems inherent in working with concentrated caustic solutions have heretofore presented problems. Thus, in TRITON BG-5, Technical Bulletin of Rohm and Haas Company, Philadelphia, Pa., June 1968, it is taught that up to 1% by weight of a nonionic surfactant and an alkoxylated glycidyl ether can be solubilized in 50% sodium hydroxide solution. U.S. Pat. No. 3,437,598 discloses aqueous concentrates comprising 40% to 70% caustic soda and between about 0.005% to 1% of a water-soluble adduct of glycidol and an alkylphenol.

SUMMARY OF THE INVENTION

The liquid cleaning concentrate of this invention consists essentially of an aqueous solution of alkali metal hydroxide, and a substantial amount of a nonionic surfactant and/or an alkyl glucoside or alkoxylated glycidyl ether. The composition is prepared by providing an aqueous solution of the nonionic surfactant and/or the alkyl glucoside or alkoxylated glycidyl ether and adding the alkali metal hydroxide in aqueous solution in increments until a solution is obtained. The invention provides concentrated alkaline solutions of high surfactant content while obviating the necessity of formulating with solid caustic.

DETAILED DESCRIPTION OF THE INVENTION

More in detail, the liquid cleaning concentrate of this invention consists essentially of from about 10% to about 35% by weight of alkali metal hydroxide, from about 0% to about 50% by weight of a nonionic surfactant containing a polyoxyethylene group, from about 0% to about 50% by weight of an alkyl glucoside or a glycidyl ether of an alcohol having 12 to 24 carbon atoms or an alkyl phenol, the balance of the composition being water, with the proviso that the total of the nonionic surfactant and the alkyl glucoside or glycidyl ether be in the range of about 10% to about 50% by weight.

The nonionic surfactants containing a polyoxyethylene group are synthetic compounds. Exemplary are the polyoxypropylene polyoxyethylene condensates marketed by Wyandotte Chemicals Corporation under the name Pluronic. Preferred are the low-foaming nonionic surfactants containing a polyoxyethylene group reacted with an organic hydrophobic compound such as polyoxypropylene aliphatic and aromatic alcohols; the reaction product of propylene oxide and ethylene diamine, aliphatic alcohols, alkylaryl alcohols, etc. Generally these materials are condensation products of 6–30 moles of ethylene oxide with one mole of the hydrophobic compound and may be either capped or uncapped. Typical are the condensation products of ethylene oxide with alkyl phenols, commercially known as "Triton" surfactants; condensation products of ethylene oxide with aliphatic alcohols having 12–18 carbon atoms such as those sold commercially as "Tergitol 15-S-9", "Surfonic J-4", etc.

Another component of the composition of this invention is a surfactant which is either an alkyl glucoside or a glycidyl ether of an alcohol having 12 to 24 carbon atoms or an alkyl phenol. The alkyl glucosides can be represented by the formula $ROG_nH$ wherein G is a glycosyl radical and R is an alkyl radical of 6–16 carbons connected to the number one carbon atom of a glycosyl radical through an oxygen atom. The value of n varies between 1 and 10, the compound comprising a mixture of n values, the average of which will be less than 5. Also, the alkyl radical may be straight or branched chain. Examples of suitable alkyl glucosides are hexyl glucoside, octyl glucoside, decyl glucoside, tetradecyl glucoside, hexadecyl glucoside, and mixtures such as hexa and octyl glucosides.

Exemplary glycidyl ethers of an alcohol having 12 to 24 carbon atoms or an alkyl phenol are glycidyl ethers of dodecyl alcohol, octadecyl alcohol, nonyl phenol, etc. Ethers of straight chain and branch chain alcohols and phenols and mixtures of different alkoxylated glycidyl ethers can be employed. Typical of these compounds are the materials marketed by Olin Corporation as Surfactant 6G and Surfactant 10G.

As previously indicated, the liquid cleaning concentrates of this invention are prepared by first forming a solution of the nonionic surfactant and/or the alkyl glucoside or alkoxylated glycidyl ether in sufficient water to form a first solution. An aqueous solution of alkali metal hydroxide is then added, preferably with mixing, to form a second solution. The process can be conveniently carried out at room temperature and only simple mixing equipment is required.

The aqueous solution of alkali metal hydroxide added to the first solution is generally a concentrated solution containing from about 27 to about 50% of the alkali metal hydroxide. Such solutions are commercially available, and their use obviates the necessity of handling such hazardous materials as solid caustic.

While any of the previously described liquid cleaning concentrates are effective, preferred are those compositions where the total of the nonionic surfactant and the alkyl glucoside or glycidyl ether of an alcohol having 12 to 24 carbon atoms or an alkyl phenol is in the range of about 20% to about 30% by weight, the levels of alkali metal hydroxide being as previously described and the balance being water.

The liquid cleaning concentrates of this invention can be used directly for applications where fast penetration and high detergent content are desired. Also, the concentrates can be diluted prior to use with water or additional aqueous caustic, either of which optionally can contain a chelating agent and/or additional surfactant. Illustrative chelating agents are the hydroxycarboxylic sequesterants which include the hydroxycarboxylic acids also known as sugar acids, for example, gluconic acid, lactic acid, citric acid, 2-ketogluconic acid, mucic acid, mannoic acid, etc. Other chelating agents, for example, organophosphorus compounds such as hydroxyethylidene diphosphoric acid, can be used. Exemplary surfactants include any of the previously described nonionic surfactants, or alkyl glucosides or glycidyl ethers of alcohols or alkyl phenols.

The concentrates of this invention can be diluted to any desired caustic content. For example, up to 500 parts by volume of water can be added and as little as 0.005% by weight of alkali metal hydroxide can be present in the diluted solution. Where commercial bottle washes are desired, the concentrate is generally diluted to between about 0.5% and about 5.0% by weight alkali metal hydroxide, with between about 2 and about 3% by weight being preferred. For this particular application, the diluted concentrate can be readily used in any type of bottle washing machine, including both manual cleaners and high pressure equipment.

The following examples will serve to illustrate the practice of this invention.

EXAMPLE 1

A liquid cleaning concentrate having the following composition was prepared:

| | PERCENT BY WEIGHT |
|---|---|
| Aqueous Sodium Hydroxide (50% by weight NaOH) | 45.0 |
| Triton BG-10[1] 70% active) | 30.0 |
| Water | 25.0 |

[1]Triton BG-10 is an alkyl glucoside available from Rohm and Haas Company. It is sold as an aqueous solution containing 70% by weight glucoside.

The composition was prepared by dissolving the Triton BG-10 in the water; the resultant solution was added to the aqueous sodium hydroxide with stirring.

EXAMPLE 2

A liquid cleaning concentrate having the following composition was prepared:

| | PERCENT BY WEIGHT |
|---|---|
| Aqueous Sodium Hydroxide (50% by weight NaOH) | 45.0 |
| Triton BG-10[1] 70% active) | 27.0 |
| Triton DF-16[2] | 3.0 |
| Water | 25.0 |

[1]Triton BG-10 is an alkyl glucoside available from Rohm and Haas Company. It is sold as an aqueous solution containing 70% by weight glucoside.
[2]Triton DF-16 is a capped ethoxylated alcohol available from Rohm and Haas Company.

The composition was prepared by first dissolving the Triton BG-10 in the water. To the resultant solution was added the Triton DF-16 and the mixture was stirred slowly until a solution was obtained.

EXAMPLE 3

A commercial grade cleaning composition was made by adding 35 parts by volume of the concentrate described in Example 1 to 965 parts by volume of 50% by weight aqueous sodium hydroxide. The resulting product was used in a commercial bottle soaker by diluting it to a 1%–5% sodium hydroxide content.

EXAMPLE 4

A commercial grade chelated cleaning composition was made by adding 73 parts by volume of 50% by weight aqueous gluconic acid to 892 parts by volume of 50% by weight aqueous sodium hydroxide and 35 parts by volume of the concentrate described in Example 2. The resultant composition was highly effective in cleaning recycled bottles in a beverage plant.

What is claimed is:

1. A liquid cleaning concentrate consisting essentially of:

(a) from about 10% to about 35% by weight of alkali metal hydroxide;

(b) from about 0% to about 50% by weight of a nonionic surfactant containing a polyoxyethylene group;

(c) from about 0% to about 50% by weight of an alkyl glucoside or a glycidyl ether of an alcohol having 12 to 24 carbon atoms or an alkyl phenol;

(d) the balance being water;

with the proviso that the total of the nonionic surfactant and the alkyl glucoside or glycidyl ether be in the range of about 10% to about 50% by weight.

2. The liquid cleaning concentrate of claim 1 wherein the total of the nonionic surfactant and the alkyl glucoside or glycidyl ether is in the range of about 20% to about 30% by weight.

3. The liquid cleaning concentrate of claim 1 or 2 wherein the alkali metal hydroxide is sodium hydroxide.

* * * * *